US007506994B1

(12) United States Patent
Waycaster et al.

(10) Patent No.: US 7,506,994 B1
(45) Date of Patent: Mar. 24, 2009

(54) FLUORESCENT LAMP LUMINAIRE

(75) Inventors: William Bradley Waycaster, Tupelo, MS (US); Scott Collins, Tupelo, MS (US)

(73) Assignee: Genlyte Thomas Group LLC, Louisville, KY (US)

( * ) Notice: Subject to any disclaimer, the term of this patent is extended or adjusted under 35 U.S.C. 154(b) by 26 days.

(21) Appl. No.: 11/380,785

(22) Filed: Apr. 28, 2006

Related U.S. Application Data

(60) Provisional application No. 60/676,351, filed on Apr. 29, 2005.

(51) Int. Cl.
*F21S 8/06* (2006.01)

(52) U.S. Cl. ..... 362/225; 362/147; 362/221; 362/404

(58) Field of Classification Search ..... 362/147, 362/217, 218, 219, 221, 225, 260, 297, 346, 362/414, 431, 404
See application file for complete search history.

(56) References Cited

U.S. PATENT DOCUMENTS

| | | | | | |
|---|---|---|---|---|---|
| 2,195,154 | A | * | 3/1940 | Scott | 362/225 |
| 2,344,935 | A | | 3/1944 | Whittaker | |
| 2,567,726 | A | | 9/1951 | Pistey | |
| 2,722,666 | A | | 11/1955 | Hodgkins | |
| 2,769,897 | A | | 11/1956 | Rzeszutko | |
| 2,988,633 | A | | 6/1961 | Rosenfield | |
| 3,097,903 | A | | 7/1963 | Moore | |
| 3,117,728 | A | * | 1/1964 | Waldbauer | 362/219 |
| 3,299,264 | A | | 1/1967 | Lipscomb | |
| 3,426,312 | A | | 2/1969 | Gerald | |
| 3,428,799 | A | | 2/1969 | Bassani | |
| 3,464,727 | A | | 9/1969 | Pascucci | |
| 3,512,743 | A | * | 5/1970 | Lipscomb | 362/404 |
| 3,524,050 | A | | 8/1970 | Gustine | |
| 3,685,003 | A | | 8/1972 | Watt | |
| 3,832,540 | A | | 8/1974 | Roth | |
| 3,909,100 | A | | 9/1975 | Hodge, Jr. | |
| 3,911,265 | A | | 10/1975 | Landrum et al. | |
| 4,001,571 | A | | 1/1977 | Martin | |
| 4,070,570 | A | | 1/1978 | Wetmore et al. | |
| 4,198,108 | A | | 4/1980 | Bassetto | |
| 4,288,846 | A | | 9/1981 | Fletcher et al. | |
| 4,322,783 | A | | 3/1982 | Chappell et al. | |
| 4,323,953 | A | | 4/1982 | Hutchison | |
| 4,338,653 | A | | 7/1982 | Marrero | |
| 4,407,011 | A | * | 9/1983 | Lahm | 362/225 |
| 4,422,712 | A | | 12/1983 | Koszytorz | |
| 4,498,126 | A | | 2/1985 | Hernandez | |
| 4,533,851 | A | | 8/1985 | Block et al. | |
| 4,536,832 | A | | 8/1985 | Lemons | |
| 4,542,947 | A | | 9/1985 | Flor et al. | |
| 4,597,035 | A | | 6/1986 | Lettenmeyer | |
| 4,636,841 | A | | 1/1987 | Moles et al. | |
| 4,722,039 | A | | 1/1988 | Gaugel | |
| 4,726,781 | A | | 2/1988 | Bernhart et al. | |
| 4,744,767 | A | | 5/1988 | Henrici et al. | |

(Continued)

*Primary Examiner*—Y My Quach Lee
(74) *Attorney, Agent, or Firm*—John F. Salazar; Middleton Ruetlinger

(57) ABSTRACT

The luminaire of the present invention comprises at least two channel reflectors geometrically arranged in substantially a common plane forming a light emitting region, each channel reflector has one fluorescent lamp holder extending therein and each channel reflector has a channel reflector retaining arm having a ballast therein and extending to a luminaire supporting base.

16 Claims, 9 Drawing Sheets

U.S. PATENT DOCUMENTS 4,803,600 A 2/1989 Pepping
4,842,535 A 6/1989 Velke, Sr. et al.
4,849,864 A * 7/1989 Forrest ..... 362/225
4,866,583 A 9/1989 Targetti
4,933,820 A 6/1990 Engel
5,006,970 A 4/1991 Mackiewicz
5,113,328 A 5/1992 Foster et al.
5,124,896 A 6/1992 Bentley
5,226,724 A 7/1993 Kanarek
5,274,534 A * 12/1993 Armstrong ..... 362/431
5,436,816 A 7/1995 Nagano
5,479,327 A * 12/1995 Chen ..... 362/218
5,493,482 A 2/1996 Bowen
5,521,805 A 5/1996 Lim
5,716,123 A 2/1998 Lamming
5,746,502 A 5/1998 Huang
5,800,050 A 9/1998 Leadford
5,806,967 A 9/1998 Soorus et al.
5,865,528 A 2/1999 Compton et al.
5,918,970 A * 7/1999 Brohard et al. ..... 362/431
6,024,468 A 2/2000 Kassay et al.
6,079,851 A 6/2000 Altman et al.
6,186,642 B1 2/2001 Corcorran et al.
6,283,618 B1 9/2001 Fischer et al.
6,305,816 B1 10/2001 Corcorran et al.
6,733,158 B2 5/2004 Fischer et al.
7,131,753 B1 * 11/2006 Edwards, Jr. ..... 362/220
2002/0145877 A1 * 10/2002 Johnson ..... 362/404

* cited by examiner

FLUORESCENT LAMP LUMINAIRE

CROSS-REFERENCE TO RELATED APPLICATIONS

This application claims benefit of and priority to U.S. Application Ser. No. 60/676,351, currently pending, filed on Apr. 29, 2005.

BACKGROUND OF THE INVENTION

1. Field of the Invention

The present invention relates to a lighting luminaire which more efficiently produces lumens from a compact high intensity fluorescent lamp.

2. Description of the Related Art

The need for lighting large areas has led to the development of a variety of hi-bay and low-bay luminaries. The luminaries, hi-bay and low-bay, found their name in the construction of some types of industrial facilities where a skeletal framework is used to form an interior subspace called a "bay". Yet, in the lighting industry, this term bay has expanded to encompass almost any large area to be lit. Typical applications of hi-bay and low-bay luminaries include street lighting, parking lot lighting, building flood lighting, sports arena lighting, industrial lighting, gymnasium lighting, warehouse lighting, and retail lighting.

A hi-bay luminaire generally means any installation where the luminaire is mounted high off the ground or floor while the term low-bay generally means any installation where the luminaire is mounted near the area to be illuminated. The Illuminating Engineering Society of North America (IESNA), the authority in lighting, categorizes spaces as either hi-bay (>25 ft.) or low-bay (<25 ft.). However, the terms hi-bay and lo-bay also refer to luminaires designed for these applications, although it is not uncommon to see hi-bay luminaires in low-bay applications, and vice versa. Indoor spaces such as factories, warehouses, retail stores, gymnasiums, and all-purpose rooms are most often lighted by hi-intensity discharge (HID) lamps in a hi-bay or lo-bay luminaire, depending on the distance from the luminaire to the area to be lit. HID lighting luminaires have been highly successful due to their extreme amount of output of light. Sources of HID lighting are typically mercury vapor and high pressure sodium.

The drawbacks to using HID light sources are the use of excessive amounts of energy, poor color rendition, diminishing lumen output over the life of the lamp, no choice of color temperatures, and a lack of high efficiency electronic ballasts to power the HID light sources.

An alternative to standard HID lamp is a metal halide lamp, which provides superior performance and, depending on the ballast, dimming capability. However, many of the drawbacks remain. Recently, manufacturers have begun offering specialized fluorescent luminaires as an alternative for high ceiling applications. These luminaires provide distinct advantages over HID lamps and metal halide lamps. Traditionally, fluorescent lighting has been used in applications where the lamp is within 15 ft. of the area to be illuminated, but new technology has enabled it to be competitive with HID in higher ceiling heights, even over 25 ft. (i.e. In-bay applications). Consequently fluorescent lamps are now being used in many hi-bay and low-bay applications.

Fluorescent lamps have become a substitute for HID and metal halide lamps in many applications. Fluorescent lamps emit diffuse light from long glass tubes. This characteristic of diffusivity has enabled traditional fluorescent lamps to dominate the market for lighting commercial, institutional, and industrial spaces with ceilings less than 15 feet high. The drawback with the traditional fluorescent lamps is the large quantity of luminaries required to light a large area and the lack of efficiency. The large quantities of standard fluorescent luminaires significantly increases the initial installation costs, with no advantage or savings because of the increased labor cost, when compared to the installation of HID luminaires, fluorescent luminaries have not become economically practical in many applications. The traditional fluorescent lamp also lacks the intensity needed for large spacing between lamps at high mounting levels.

More recently, the emergence of more intense and efficient compact fluorescent lamps has enabled fluorescent systems to be used in hi-bay applications. To go along with the latest in high intensity fluorescent lamps, new luminaire design variations addressing aesthetics and some specific user needs have been made. However, fluorescent luminaires have typically utilized long longitudinally extending cylindrical lamps, which are mounted at or slightly below the ceiling level, parallel to the floor surface. These fluorescent lamp luminaires usually have one (1) to four (4) lamps of four foot to eight foot lengths per luminaire, and these luminaires utilize much lower wattage per luminaire than the HID lamp luminaires. The traditional fluorescent luminaires illuminate a rectangular area and they are usually placed in rows mounted end to end.

The recent technology has brought about the high intensity compact fluorescent lamp, which is a four-prong lamp with two sets of joined ends creating a double inverted "U" effect relative to the base. The normal wattage for these double "U" shaped fluorescent lamps is from 5 to 26 wattage per lamp. The biax fluorescent is another new technology utilizing a single elongated narrow "U" effect relative to the base. The normal wattage for these biax lamps is from twenty six (26) to fifty five (55) watts.

The new fluorescent luminaires lamps have several advantages over HID lamps: lower energy consumption, lower lumen depreciation rates, better dimming options, faster start-up and restrike, better color rendition, more pupil lumens, and reduced glare. These advantages make fluorescent luminaires more cost-effective in many applications, and enable them to provide superior lighting to the spaces they illuminate.

However, current luminaries fail to take advantage of the advances made in high intensity fluorescent lamps. Current luminaires have all the lamps in a single optical chamber. This reduces the overall light output or efficiency of the luminaire. When lamps are placed adjacent to one another in a single optical chamber, a portion of the light emanating from one is absorbed by the other(s). Other problems exist with current luminaire designs for compact high intensity fluorescent lamps such as they do not consider maintaining optimum lamp operating temperatures or provide efficient lighting of the area below nor do they provide aesthetically pleasing luminaires for the compact fluorescent lamps.

What is needed is a luminaire for compact high intensity fluorescent lamps that provides efficient lighting to the area below and offers aesthetic appeal.

SUMMARY OF THE INVENTION

The present invention provides a luminaire utilizing multiple long twin tube compact fluorescent lamps (i.e. Philips PL-L lamps) that serves as a low-bay or optionally hi-bay luminaire while maintaining high luminaire efficiency. The luminaire of the present invention has a wide spacing to mounting height ratio. It provides symmetrical light distribution while utilizing compact fluorescent lamps. The luminaire is mounted with a single pendant and can be easily installed in an elevated ambient environment.

The present invention provides a luminaire assembly that includes an elongated ballast housing or support arm, a wiring box mounted to an upper end of the ballast housing, and a channel reflector mounted to a lower end of the ballast housing. The ballast housing is adapted to enclose a ballast and associated electrical hardware. Each of the ballast housing members preferably has a panel that permits access to the ballast and associated wiring. The optical assembly comprises at least one channel reflector having a single lamp holder.

Electronic ballast and lamps are sensitive to heat and thus degrade the performance unless properly positioning and venting is established. The present invention holds each lamp and ballast in an individual compartment. Therefore, heat generated from a lamp or ballast does not serve to degrade the performance of other ballasts and lamps contained in the luminaire. This configuration improves the overall light output or efficiency of the luminaire.

When lamps are placed adjacent to one another in a single reflecting channel a portion of the light emanating from one lamp is absorbed by the other(s). The placement of the lamps in separate reflecting channels in an end to end or side by side pattern symmetrical distributes light, as well as eliminates the absorbance of light from one lamp by another. This configuration too contributes to the efficiency of the luminaire of the present invention.

A mounting/wiring box or luminaire base with a conduit fitting is above the optical portion of the luminaire to achieve a single point mounting. This configuration provides for easy installation of the luminaire. The ballasts are positioned in individual ballast housing arms or channel reflector retaining arms which extend between the optical portion of the luminaire and the wiring box. This positioning serves two purposes. First, it separates the lamp and ballast maintaining optimum thermals yet the ballasts are still an integral part of the luminaire (i.e. not remotely mounted) thus maintaining ease of installation. Secondly, the arms connect the optical portion of the luminaire to the mounting/wiring box providing adequate structural support for the luminaire.

Within the low-bay/hi-bay unit twin tube or "U" lamps are installed in a vertical orientation, an imaginary line from the center of each tube of a twin tube lamp would be substantially perpendicular to the horizon when the luminaire is mounted. This orientation allows more of the light emanating from each tube to be encompassed by the channel reflector. The channel reflector in turn redirects the light from the lamp at wide angles producing a wide spacing to mounting height ratio.

BRIEF DESCRIPTION OF THE DRAWINGS

The present invention can best be understood in connection with the accompanying drawings, in which.

DETAILED DESCRIPTION

The following describes a fluorescent luminaire, numerous specific details and alternative configurations are set forth in order to provide an understanding of the present invention. It should be appreciated that such descriptions are merely for convenience and that such are selected solely for the purpose of illustrating the invention. Other and different fluorescent luminaires may utilize the inventive features described herein. Hence, reference to the figures showing several embodiments of the present invention is made to describe the invention and not to limit the scope of the disclosure and claims herein.

Figure 1:
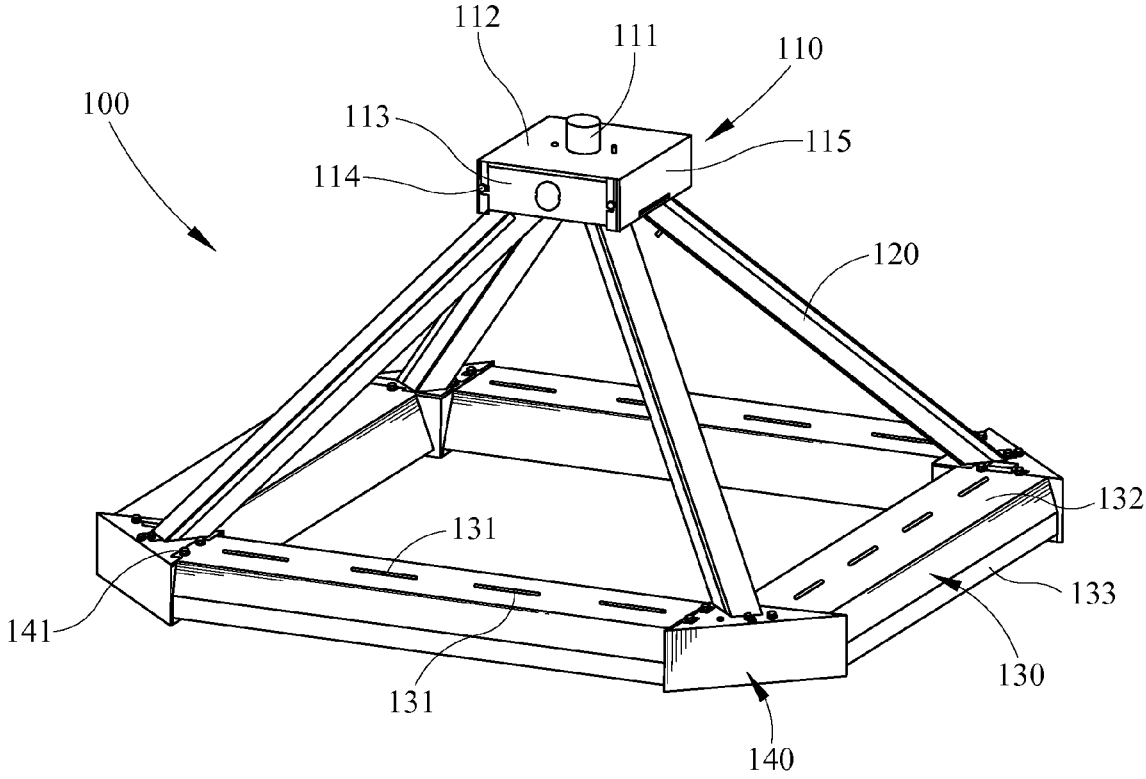
FIG. 1 is a perspective view of an embodiment of the fluorescent lamp luminaire of the present invention having four channel reflectors, an extending conduit fitting, chamfered corners, and a rectangular shaped optical region.

Referring to FIG. 1, showing an embodiment of the fluorescent lamp luminaire of the present invention, the instant invention is described. Shown here is luminaire 100 having four channel reflectors 130 arranged in a substantially planar square pattern forming a light emitting region. Channel reflectors 130 have a top wall 132 and a pair of opposing downwardly depending side walls 133. The inner side of channel 130 advantageously has a reflective or specular surface, optionally it may be white in color. The top wall 132 of channel reflectors 130 have vents 131 for releasing heat generated by a lamp. This release of heat helps to maintain lamp temperatures in a range where the lamps perform efficiently. Each channel reflector 130 is joined at each end to an adjacent channel reflector 130 with chamfered corner joiners 140 which are retained to adjacent channel reflectors 130 with retainers 141. Retainers 141 may be screws, rivets, or any retaining means known by one having ordinary skill in the art. Depending inwardly and upwardly from each corner 140 is a channel reflector retaining arm 120. A first end of each channel reflector retaining arm 120 is engaged with the light emitting region, in this embodiment chamfered corner joiners 140, and a second end being engaged with base 110. Luminaire supporting base 110 has a substantially centrally located upwardly appending conduit fitting 111 and functions as a wiring box. Supporting base 110 has top wall 112, three downwardly depending side walls 115 and a wire access panel 113 removably joined to two opposing side walls 115 with joiners 114. Joiners 114 may be screws, rivets, or any retaining means known by one having ordinary skill in the art. When luminaire 100 is installed, the luminaire wiring extends from conduit fitting 111 to lamp holders in the light emitting region through channel reflector retaining arms 120.

Figure 2:
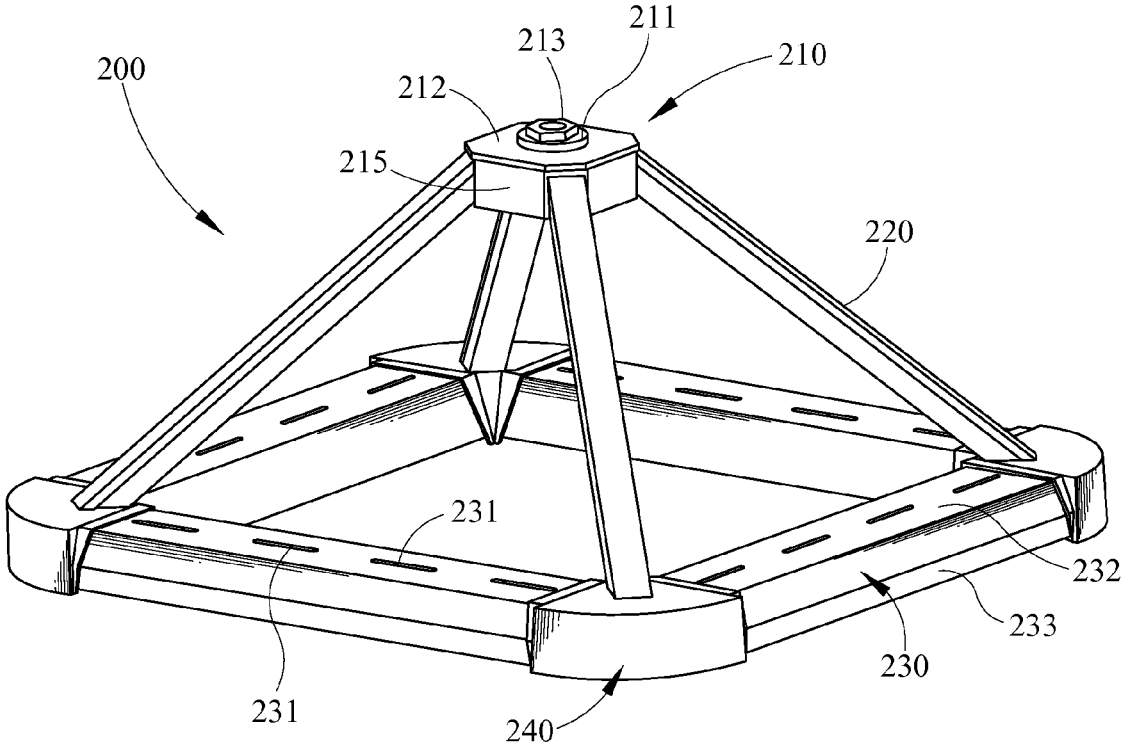
FIG. 2 is a perspective view of an embodiment of the fluorescent lamp luminaire of the present invention having four channel reflectors, a nut and hub conduit fitting, rounded corners, and a rectangular shaped optical region.

Referring to FIG. 2, showing an alternative embodiment of the fluorescent lamp luminaire of the present invention, the instant invention is described. Shown here is luminaire 200 having four channel reflectors 230 arranged in a substantially planar square pattern forming a light emitting region. Channel reflectors 230 have a top wall 230 and a pair of opposing downwardly depending side walls 233. The top wall 232 of channel reflectors 230 have vents 231 and each channel reflector 230 is joined at each end to an adjacent channel reflector 230 with rounded corner joiners 240 forming a substantially square pattern. Depending inwardly and upwardly from each rounded corner 240 is a channel reflector retaining arm 220. A first end of each channel reflector retaining arm 220 is engaged with the light emitting region, in this embodiment rounded corner joiners 240, and a second end being engaged with base 210. Luminaire supporting base 210 has a substantially centrally located nut 213 and hub 211 conduit fitting and functions as a wiring box. Supporting base 210 has top wall 212 and four downwardly depending side walls 215. When luminaire 200 is installed, the luminaire wiring extends from nut 213 and hub 211 fitting to lamp holders in the light emitting region through channel reflector retaining arms 220.

Figure 3:
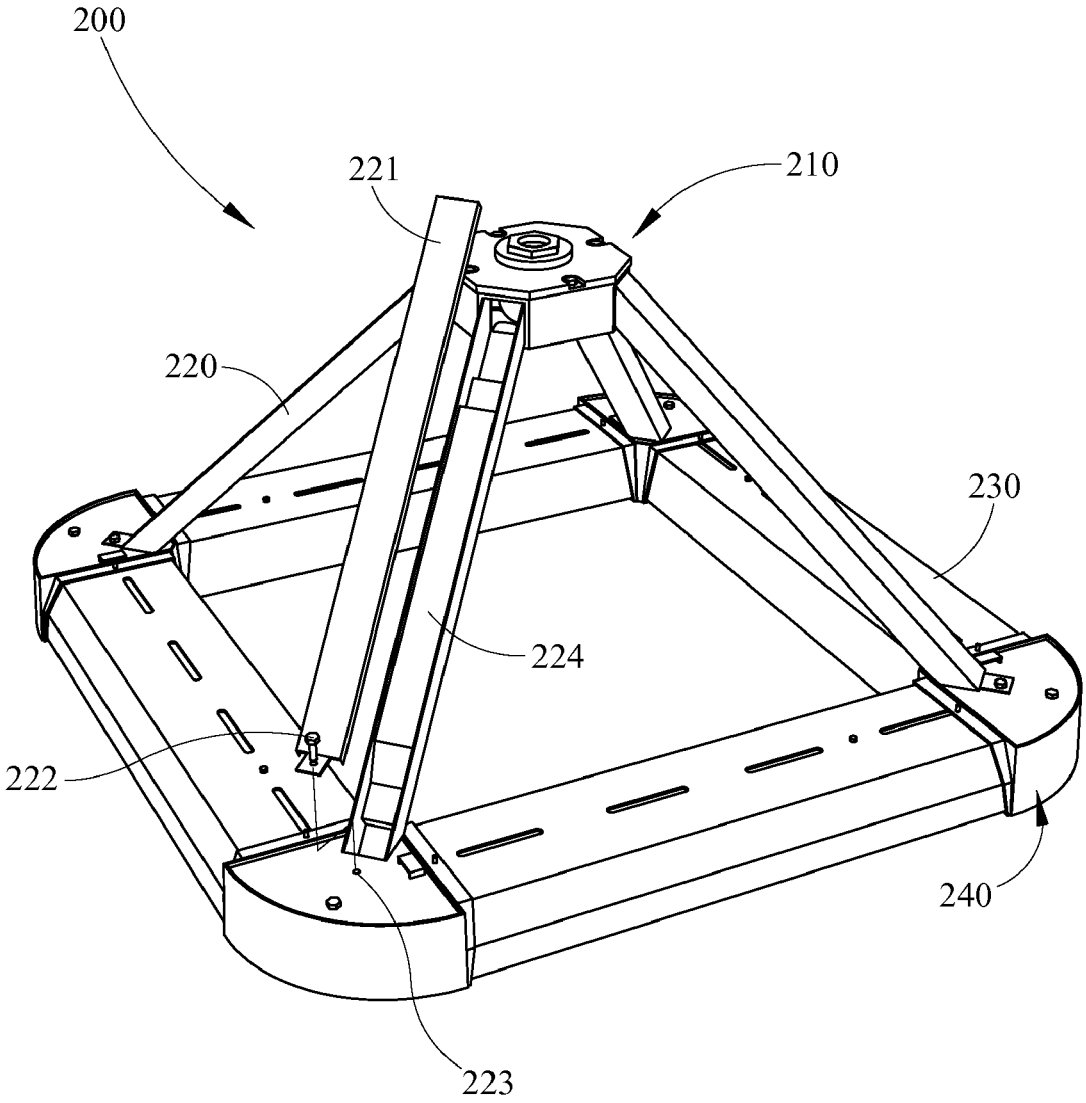
FIG. 3 shows a partially exploded view of the embodiment of the fluorescent lamp shown in FIG. 2 having a retaining arm cover removed.

FIG. 3 shows an exploded view of retaining arm 220 of the embodiment of fluorescent luminaire 200 shown in FIG. 2. Luminaire 200 has four channel reflectors 230 arranged in a rectangular pattern. Between each corner formed by four channel reflectors 230 and base 210 is a channel reflector retaining arm 220. Each channel reflector retaining arm 220 has a removably retained top wall or ballast cover 221. Ballast cover 221 is removably retained to rounded corner piece 240 by retainer 222 in ballast cover retaining hole 223 in rounded corner 240. Within each retaining arm 220 is a ballast 240 and wiring extending therefrom to a lamp holder in a channel reflector 230 and to wiring box or support base 210. The unique configuration of having ballast 224 retained in luminaire retaining arms 220 also helps in maintaining an optimum temperature within channel reflectors 230 increasing the efficiency of a lamp therein. Traditional luminaires house ballasts within or on a top wall of channel reflector 230 thus causing heat generated to warm a lamp therein and/or block the escape of heat through vents 231. Therefore, having ballasts 224 retained in channel reflector retaining arms improves the efficiency of luminaire 200 over traditional luminaries.

Figure 4:
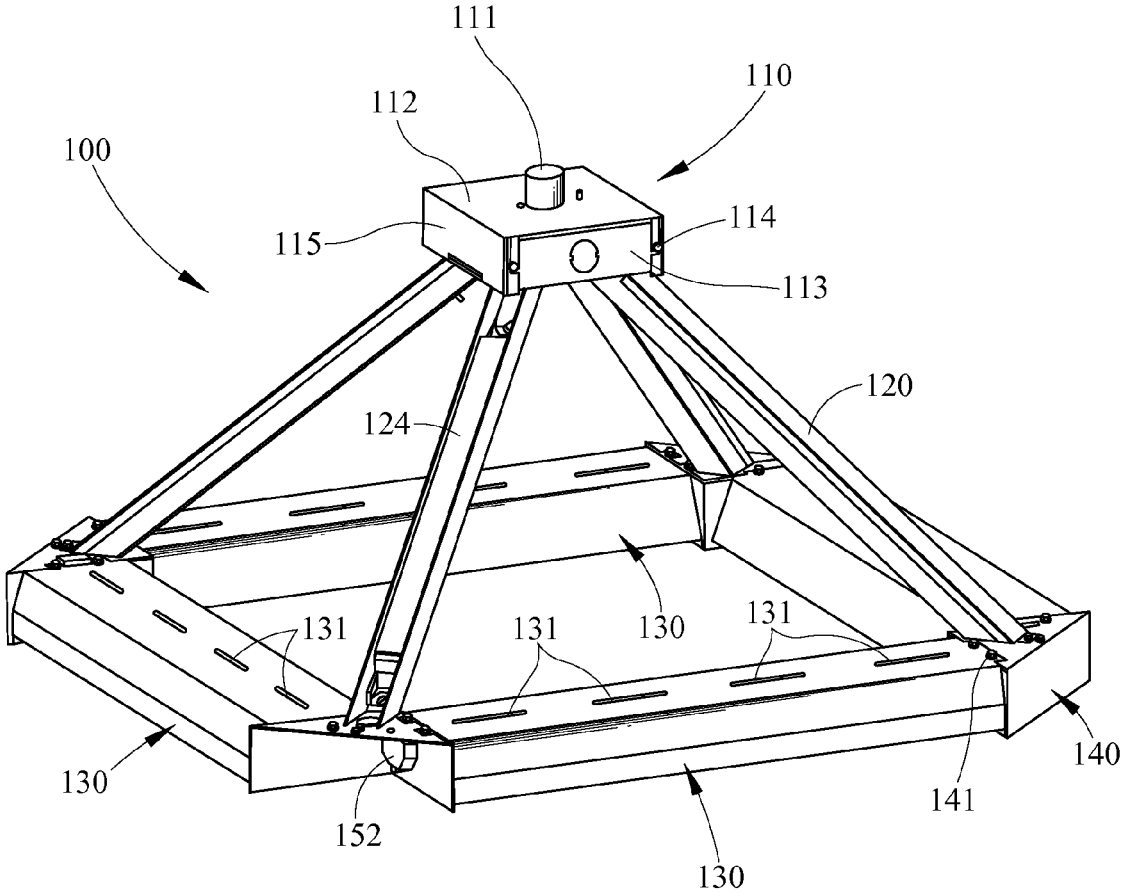
FIG. 4 shows a partially exploded view of the embodiment of the fluorescent lamp shown in FIG. 1 having a retaining arm cover and chamfered corner section removed.

FIG. 4 shows the fluorescent lamp luminaire 100 of FIG. 1 having a chamfered corner 140 and a top wall of a channel reflector retaining arm removed. Having chamfered corner 140 removed shows lamp holder 152 extending into an end wall of channel reflector 130. Only one end wall of channel reflector 130 has a lamp holder 152. Lamp holder 152 is electrically connected to a ballast 224 in a channel reflector retaining arm 220 wherein the ballast is also electrically connected to wiring box 110.

Figure 5:
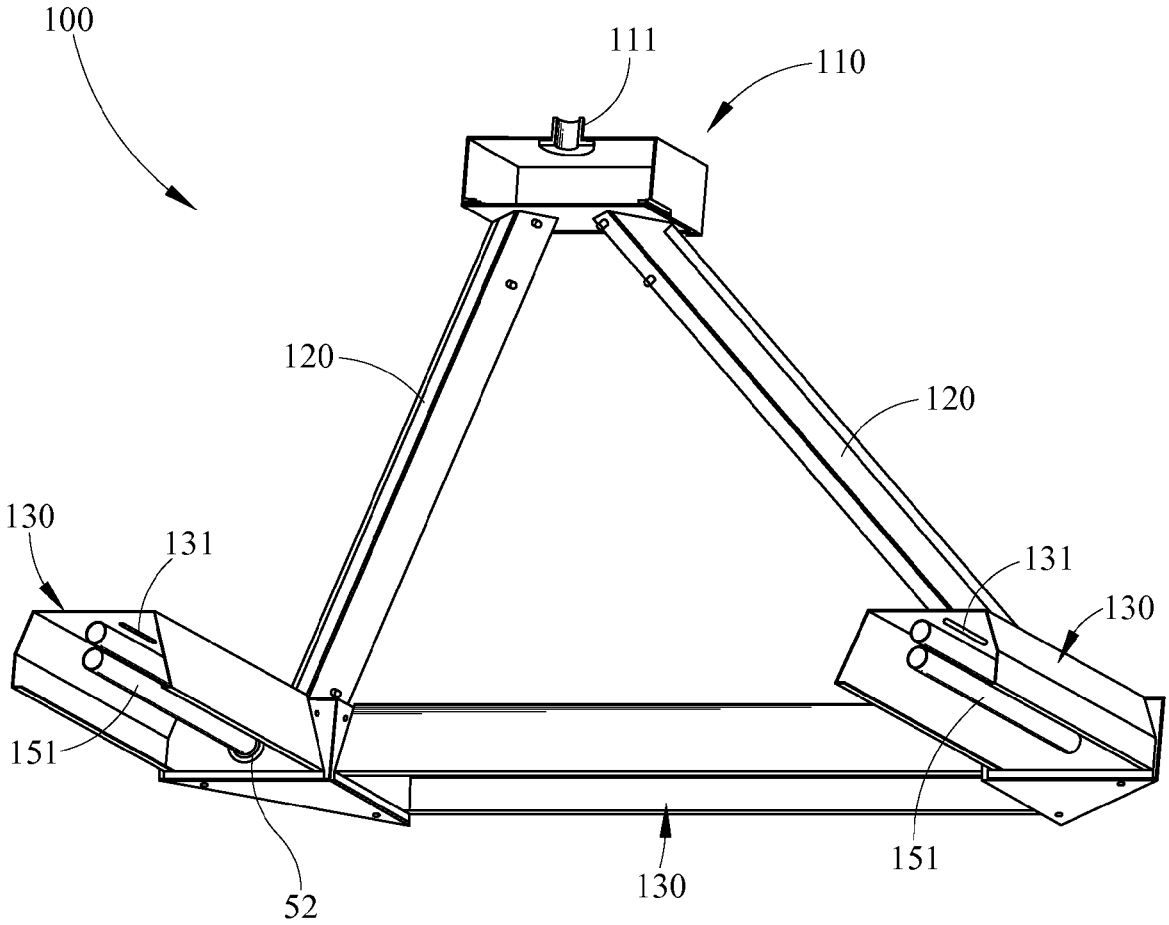
FIG. 5 shows a cross sectional view of the fluorescent luminaire of FIG. 1. showing the orientation of the fluorescent lamps in the channel reflectors.

FIG. 5 shows a cross sectional view of fluorescent luminaire 100 of FIG. 1. Shown here is a single "U" shaped high intensity fluorescent lamp 151 in each channel reflector 130. A single lamp holder 152 is shown extending into an end wall of channel reflector 130 holding a single fluorescent lamp 151.

Figure 6:
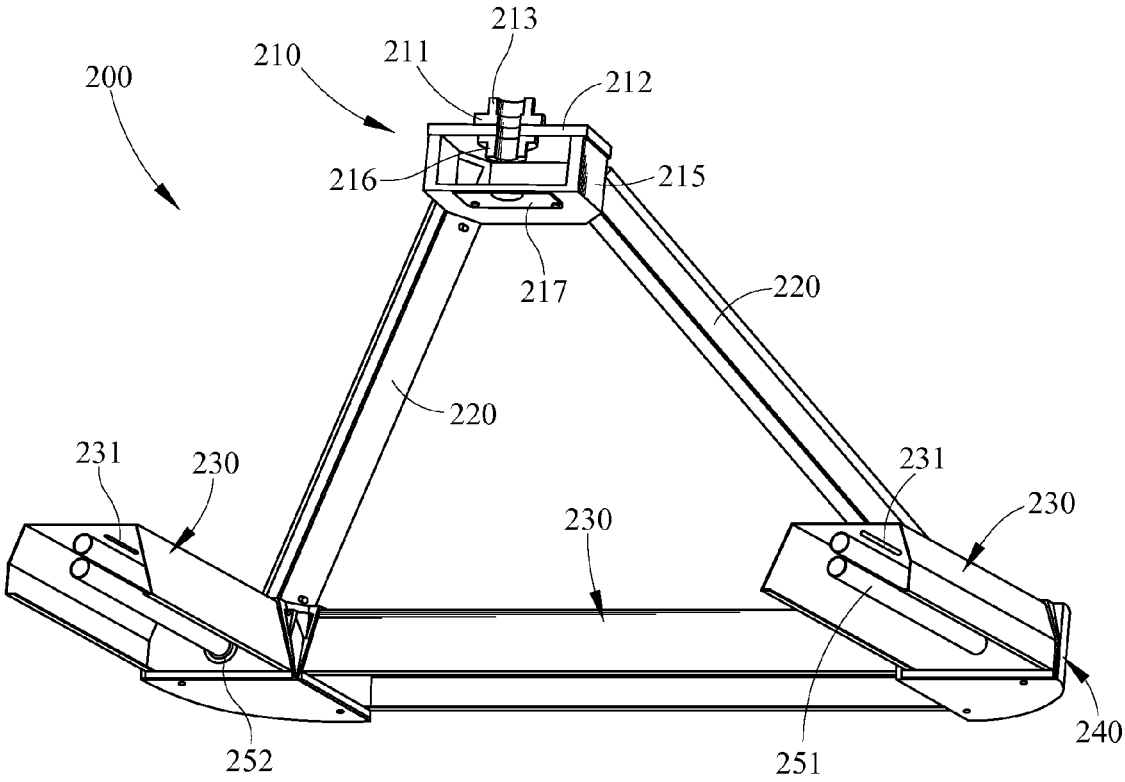
FIG. 6 shows a cross sectional view of the fluorescent luminaire shown in FIG. 2. showing the orientation of the fluorescent lamps in the channel reflectors and a wire access panel in the wiring box.

FIG. 6 shows a cross sectional view of fluorescent luminaire 200 of FIG. 2. Shown here is a single "U" shaped high intensity fluorescent lamp 251 in each channel reflector 230. A single lamp holder 252 is shown extending into an end wall of channel reflector 230 holding a single fluorescent lamp 251. Also shown here is lower wire access panel 217 in wiring box or luminaire supporting base 210.

Figure 7:
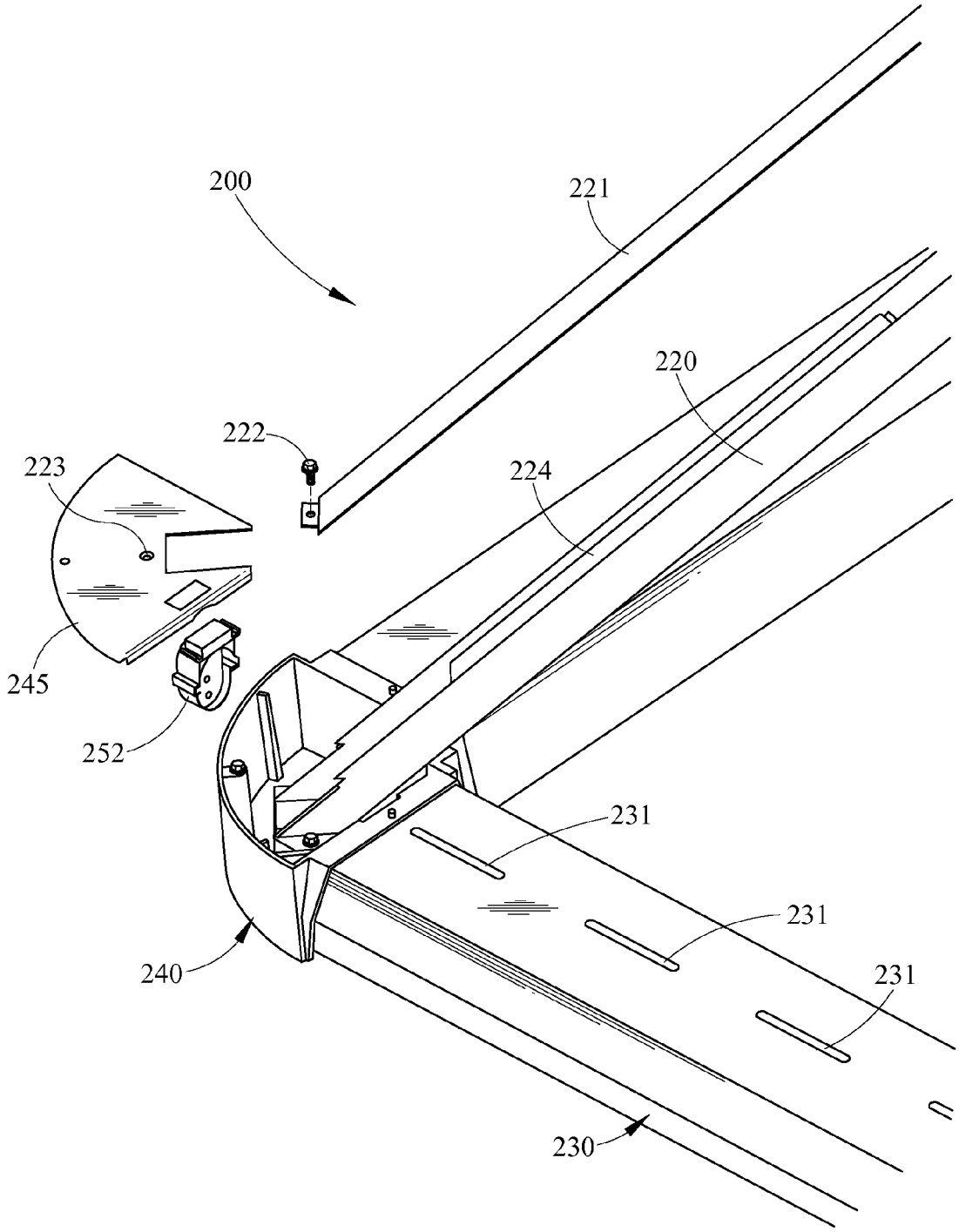
FIG. 7 shows an exploded sectional view of the fluorescent luminaire of FIG. 2. having a ballast cover and rounded corner section removed.

FIG. 7 shows an exploded sectional view of fluorescent luminaire 200 of FIG. 2. Shown here is a rounded corner section 240 having a top wall 245 removed and having ballast cover retaining holes 223. A single lamp holder 252 is shown removed from rounded corner section 240. Ballast cover or reflective channel retaining arm top wall 221 is shown removed from channel reflector retaining arm 220. Ballast cover retainer 222 is shown removed and in spaced relation to ballast cover 221.

Figure 8:
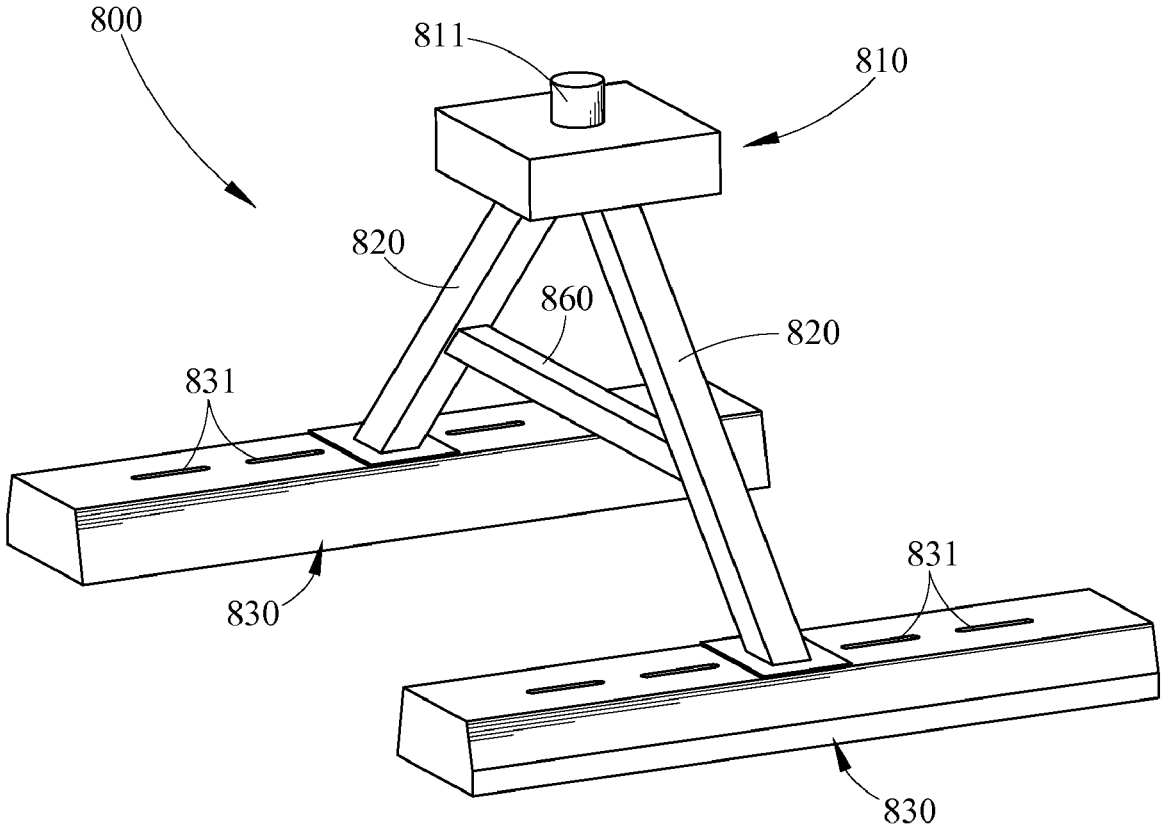
FIG. 8 shows an alternative embodiment of the present invention where the fluorescent luminaire has two channel reflectors arranged in a substantially parallel configuration.

FIG. 8 shows an alternative embodiment of the present invention where luminaire 800 has two channel reflectors 830 arranged in a substantially planar parallel pattern forming a light emitting region. Channel reflectors 830 have vents 831 in a top wall for releasing heat generated by a lamp. Depending inwardly and upwardly from a center portion of each channel reflector 830 is a channel reflector retaining arm 820. A first end of each channel reflector retaining arm 820 is engaged with the light emitting region, in this embodiment a center portion of channel reflectors 830, and a second end being engaged with a base or wiring box 810. Spanning between channel reflector retaining arms is optional support 860. Luminaire supporting base 810 has a substantially centrally located upwardly appending conduit fitting 811.

Figure 9:
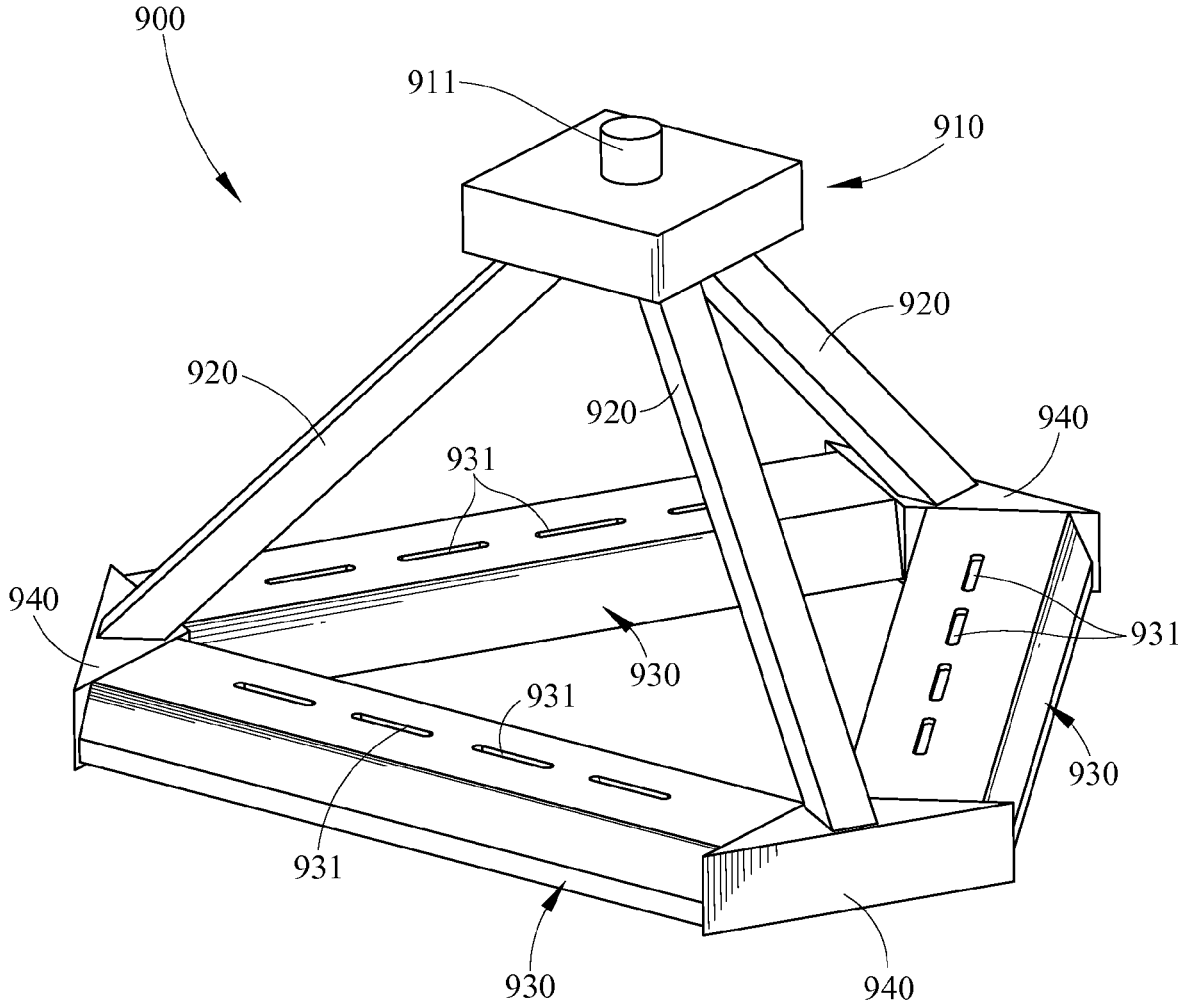
FIG. 9 shows yet another alternative embodiment of the present invention where the fluorescent luminaire has three channel reflectors arranged in a substantially triangular configuration.

FIG. 9 shows yet another alternative embodiment of the present invention where luminaire 900 has three channel reflectors 930 arranged in a substantially planar triangular pattern forming a light emitting region. Channel reflectors 930 have vents 931 in a top wall for releasing heat generated by a lamp. Depending inwardly and upwardly from chamfered corners 940 joining the ends of each channel reflector 930 together forming a triangular pattern is a channel reflector retaining arm 920. A first end of each channel reflector retaining arm 920 is engaged with the light emitting region, in this embodiment a chamfered corner 940, and a second end being engaged with a base or wiring box 910. Luminaire supporting base 910 has a substantially centrally located upwardly appending conduit fitting 911.

In accordance with the principles of the present invention, a fluorescent luminaire is provided that has an optical region comprised of at least one channel reflector having a single fluorescent lamp holder. Elongated ballast housings extend from a wiring box to each channel reflector. The ballast housing is adapted to enclose a single ballast and the luminaire has a separate ballast housing or support arm for each channel reflector. The configuration of the components of the fluorescent lamp luminaire provides increased efficiency.

We claim:

1. A luminaire comprising:

at least two channel reflectors geometrically arranged in substantially a common plane forming a light emitting region, each of said at least two channel reflectors has one fluorescent lamp region;

each of said fluorescent lamp regions having a lamp retained therein;

a luminaire supporting base;

at least one channel reflector retaining arm wherein each of said at least one channel reflector retaining arm has a first end and a second end, said first end physically supporting said light emitting region and said second end being engaged with said base;

wherein said at least one channel reflector retaining arm has a ballast compartment receiving a ballast therein, said ballast electrically connected to at least one of said lamps in order to maintain optimal thermal characteristic in said light emitting region;

wherein said luminaire supporting base has a substantially centrally located upwardly appending conduit fitting;

wherein said luminaire supporting base is a wiring box having wires extending toward said at least one channel reflector retaining arm and said upwardly appending conduit fitting.

2. The luminaire of claim 1 wherein said wiring box has a wire access opening covered with a removable wire access plate.

3. The luminaire of claim 1 wherein said at least two channel reflectors each have a top wall and two opposing downwardly depending side walls, said top walls having vents.

4. The luminaire of claim 1 wherein said at least two channel reflectors each have a top wall and two opposing downwardly depending side walls, said top and side walls having an inner light reflective surface.

5. The luminaire of claim 1 wherein said at least two channel reflectors each have opposing longitudinal ends wherein one of said opposing longitudinal ends has a long twin tube compact fluorescent lamp holder therein.

6. The luminaire of claim 1 wherein said at least two channel reflectors has two channel reflectors substantially within said light emitting region.

7. The luminaire of claim 6 wherein said two geometrically arranged channel reflectors are arranged in a substantially parallel configuration.

8. The luminaire of claim 1 wherein said at least two channel reflectors has three channel reflectors substantially within said light emitting region.

9. The luminaire of claim 8 wherein said three geometrically arranged channel reflectors are arranged in a substantially triangular configuration.

10. The luminaire of claim 1 wherein said at least two channel reflectors has four channel reflectors substantially within said light emitting region.

11. The luminaire of claim 10 wherein said four geometrically arranged channel reflectors are arranged in a substantially square configuration.

12. The luminaire of claim 1 wherein said at least one channel reflector retaining arm has a ballast receiving opening, a ballast receiving space, and a cover removeably attached thereto and covering said ballast receiving opening and said ballast.

13. The luminaire of claim 6 wherein each of said at least two channel reflectors have a long twin tube compact fluorescent lamp vertically held by said twin tube compact fluorescent lamp holder.

14. A luminaire comprising:

at least two channel reflectors geometrically arranged in substantially a common plane forming a light emitting region, each of said at least two channel reflectors has one fluorescent lamp region;

each of said fluorescent lamp regions having a lamp retained therein;

a luminaire supporting base;

at least one channel reflector retaining arm wherein each of said at least one channel reflector retaining arm has a first end and a second end, said first end physically supporting said light emitting region and said second end being engaged with said base;

wherein said at least one channel reflector retaining arm has a ballast compartment receiving a ballast therein, said ballast electrically connected to at least one of said lamps in order to maintain optimal thermal characteristic in said light emitting region;

wherein said at least two geometrically arranged channel reflectors have opposing open ends, one of said opposing open ends of a first of said at least two channel reflectors and one of said opposing open ends of a second of said at least two channel reflectors each engage a channel connecting section, said channel connecting section has a lamp holder with a wiring side and a lamp receiving side, said wiring side of said lamp holder being accessible from said channel connecting section and said lamp receiving side being accessible from one of said at least two channel reflectors.

15. A luminaire comprising:

a ceiling mounting base;

at least two luminaire support arms extending from said ceiling mounting base;

at least one of said support arms having a ballast retaining compartment and cover, said compartment having a ballast retained therein;

at least two channel reflectors, each of said at least two channel reflectors being geometrically supported by one of said at least two luminaire support arms and having a fluorescent lamp supported therein;

wherein said ballast in said support arm is electrically connected to at least one of said lamps in order to thermally isolate said ballast from said channel reflectors wherein said ceiling mounting base forms a wiring junction box and further has a substantially central hub for receiving electrical wiring received through said hub into said junction box and towards at least one of said channel reflectors through at least one of said luminaire support arms.

16. A luminaire comprising at least two high intensity fluorescent lamps, wherein each of said at least two high intensity fluorescent lamps are housed in a separate channel reflector, each of said channel reflectors being supported to a single ceiling mounting base with an individual luminaire support arm and arranged in a geometric pattern in substantially a common plane with respect to one another, said ceiling mounting base forming a junction box and having a substantially centrally located electrical conduit hub for receiving electrical wiring, wherein said wiring extends from said junction box through said at least one luminaire support arm, wherein at least one of said luminaire support arms houses a ballast and associated wiring for said channel reflector which it supports electrically connecting said ballast to said at least one of said lamps by said associated wiring extending from said junction box.

* * * * *